US008714396B2

(12) United States Patent
Hug

(10) Patent No.: US 8,714,396 B2
(45) Date of Patent: May 6, 2014

(54) INSERT FOR A TRANSPORT CONTAINER MADE OF PLASTIC MATERIAL

(75) Inventor: Yves Hug, Oberwil-Lieli (CH)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/509,949

(22) PCT Filed: Nov. 5, 2010

(86) PCT No.: PCT/IB2010/055033

§ 371 (c)(1),
(2), (4) Date: May 15, 2012

(87) PCT Pub. No.: WO2011/058489

PCT Pub. Date: May 19, 2011

(65) Prior Publication Data

US 2012/0223083 A1 Sep. 6, 2012

(30) Foreign Application Priority Data

Nov. 16, 2009 (CH) ..... 1752/09

(51) Int. Cl.
*B65D 21/032* (2006.01)
*B65D 25/04* (2006.01)

(52) U.S. Cl.
USPC ..... 220/528; 206/512; 220/507

(58) Field of Classification Search
USPC ..... 206/511, 512, 516, 600; 220/528, 23.6, 220/4.03, 507
See application file for complete search history.

(56) References Cited

U.S. PATENT DOCUMENTS

| | | | | |
|---|---|---|---|---|
| 3,459,326 | A * | 8/1969 | Betjemann | 220/1.5 |
| 3,955,681 | A * | 5/1976 | DeZinno | 211/85.1 |
| 4,512,473 | A * | 4/1985 | Thomaswick et al. | 206/454 |
| 4,884,683 | A * | 12/1989 | Ford | 206/163 |
| 5,605,242 | A * | 2/1997 | Hwang | 220/8 |
| 5,615,791 | A * | 4/1997 | Vatelot et al. | 215/382 |
| 5,918,751 | A * | 7/1999 | Kelly | 211/194 |
| 7,992,738 | B2 * | 8/2011 | Gao et al. | 220/4.27 |
| 2008/0142391 | A1 * | 6/2008 | Angeletti et al. | 206/448 |
| 2011/0210023 | A1 * | 9/2011 | DeForest | 206/304.2 |

FOREIGN PATENT DOCUMENTS

| | | | |
|---|---|---|---|
| DE | 210540783 | A1 | 5/1973 |
| DE | 20 2006 016566 | U1 | 12/2006 |
| DE | 10 2006 058031 | B3 | 7/2008 |
| EP | 0 841 254 | A1 | 5/1998 |

* cited by examiner

*Primary Examiner* — Mickey Yu
*Assistant Examiner* — Niki Eloshway
(74) *Attorney, Agent, or Firm* — Henry M. Feiereisen LLC

(57) ABSTRACT

An insert for a transport container made of plastic material includes a grid-shaped layout for glasses and the like that includes plastic strips. At least two substantially identical insert parts are provided, which are connected to each other at a distance by at least two height-adjustable support elements. Different inserts can be stacked on one other.

9 Claims, 4 Drawing Sheets

INSERT FOR A TRANSPORT CONTAINER MADE OF PLASTIC MATERIAL

CROSS-REFERENCES TO RELATED APPLICATIONS

This application is the U.S. National Stage of International Application No. PCT/IB2010/055033, filed Nov. 5, 2010, which designated the United States and has been published as International Publication No. WO 2011/058489 and which claims the priority of Swiss Patent Application, Serial No. 0175209, filed Nov. 16, 2009, pursuant to 35 U.S.C. 119(a)-(d).

BACKGROUND OF THE INVENTION

The invention relates to an insert for a transport container of plastic according to the preamble of patent claim 1.

STATE OF THE ART

It is known to use for the transport of glasses a transport container with an insert of plastic strips which intersect one another so as to hold the glasses in a transport container in a shockproof manner. Such inserts are configured for a particular size of glasses so that the use of other inserts is required when glasses of a different diameter and/or greater height are involved.

OBJECT OF THE INVENTION

It is therefore an object of the present invention to improve an insert of the afore-described type such that a single insert can be used for glasses of different height.

SUBJECT MATTER OF THE INVENTION

This object is solved by an insert for a transport container of plastic, including a grid-shaped layout comprised of plastic strips for glasses or the like, wherein at least two substantially identical insert parts are provided which are connected to each other at a distance by at least two height-adjustable support elements.

The insert according to the invention has the great advantage of allowing adjustment of various heights by the use of two identical parts with interposed support elements so that several inserts of varying heights can be provided for glasses in a simple manner. The insert according to the invention provides therefore a stable and shock-resistant hold for glasses of different heights and can easily be integrated in existing transport containers.

DESCRIPTION OF AN EXEMPLARY EMBODIMENT OF THE INVENTION

Figure 1:
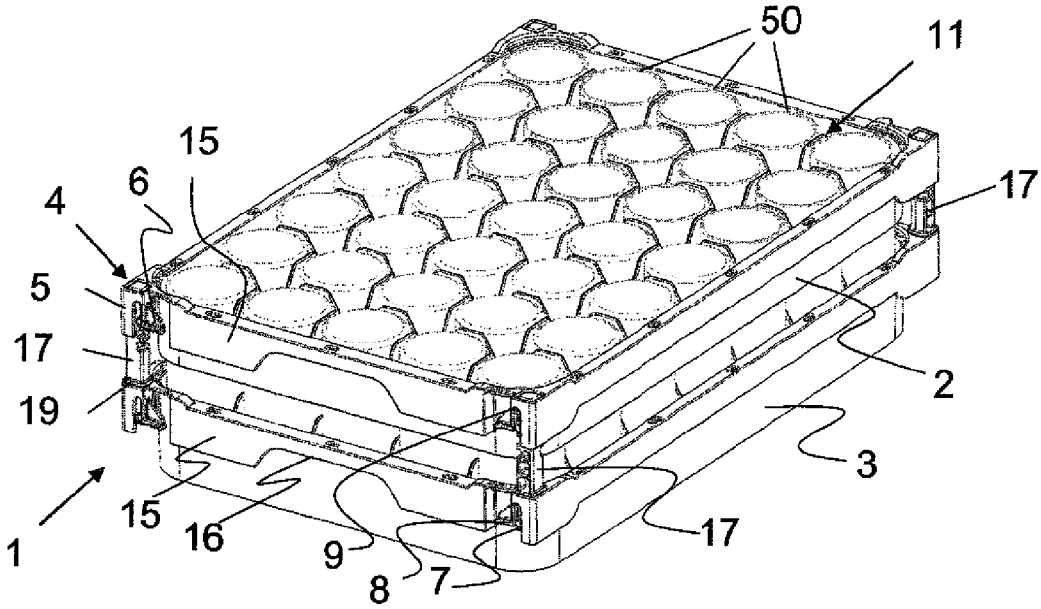
Figure 2:
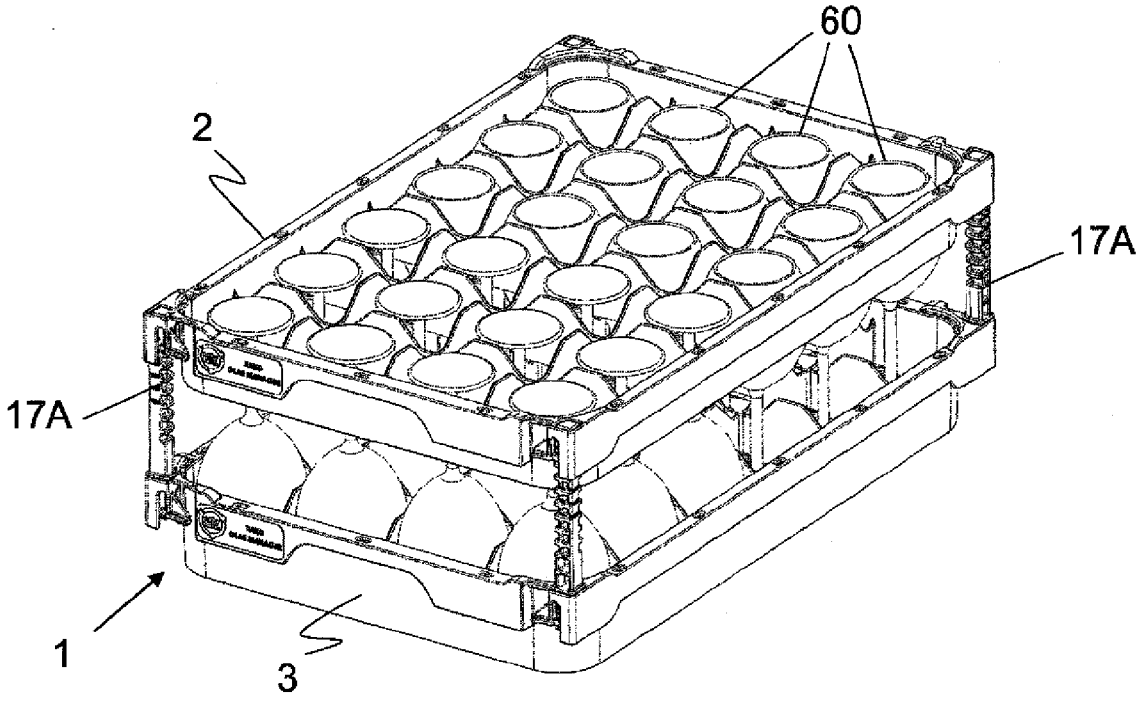
Figure 3:
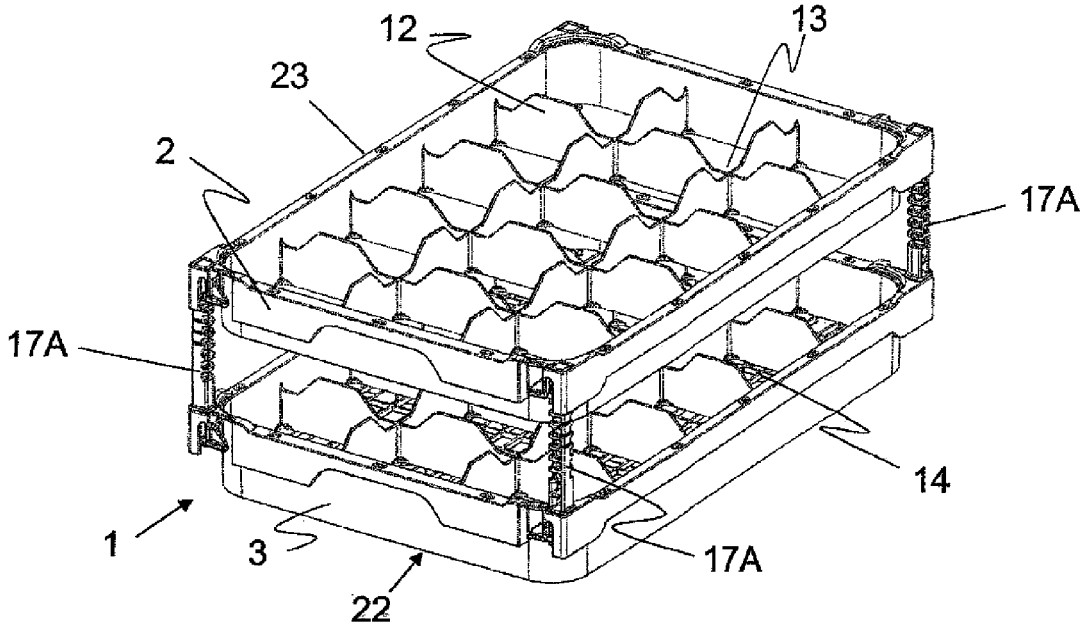
Figure 4:
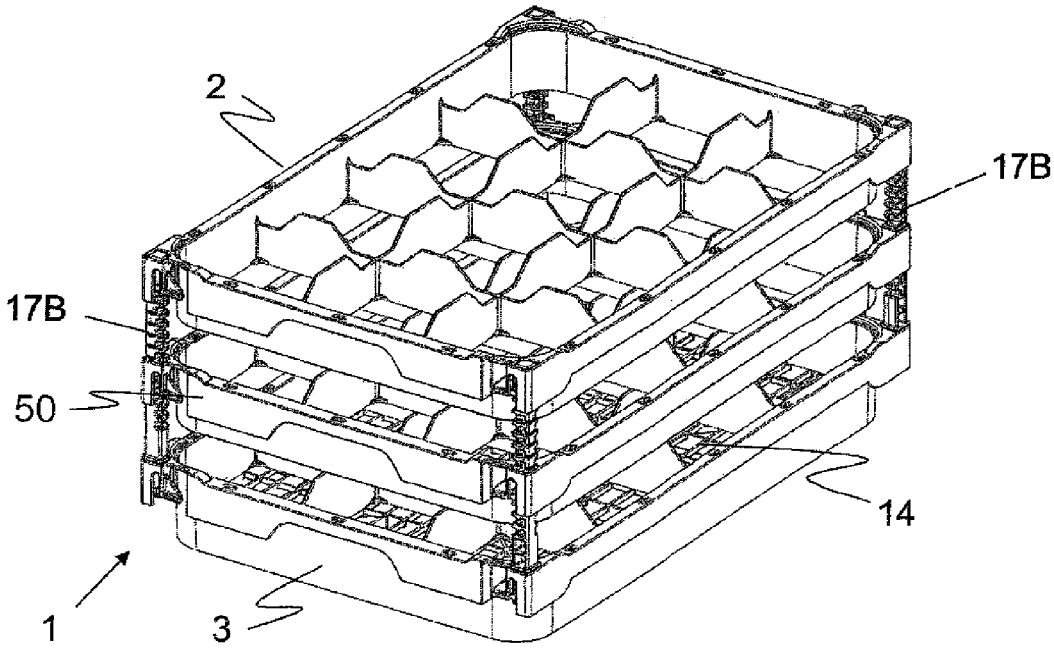
Figure 5:
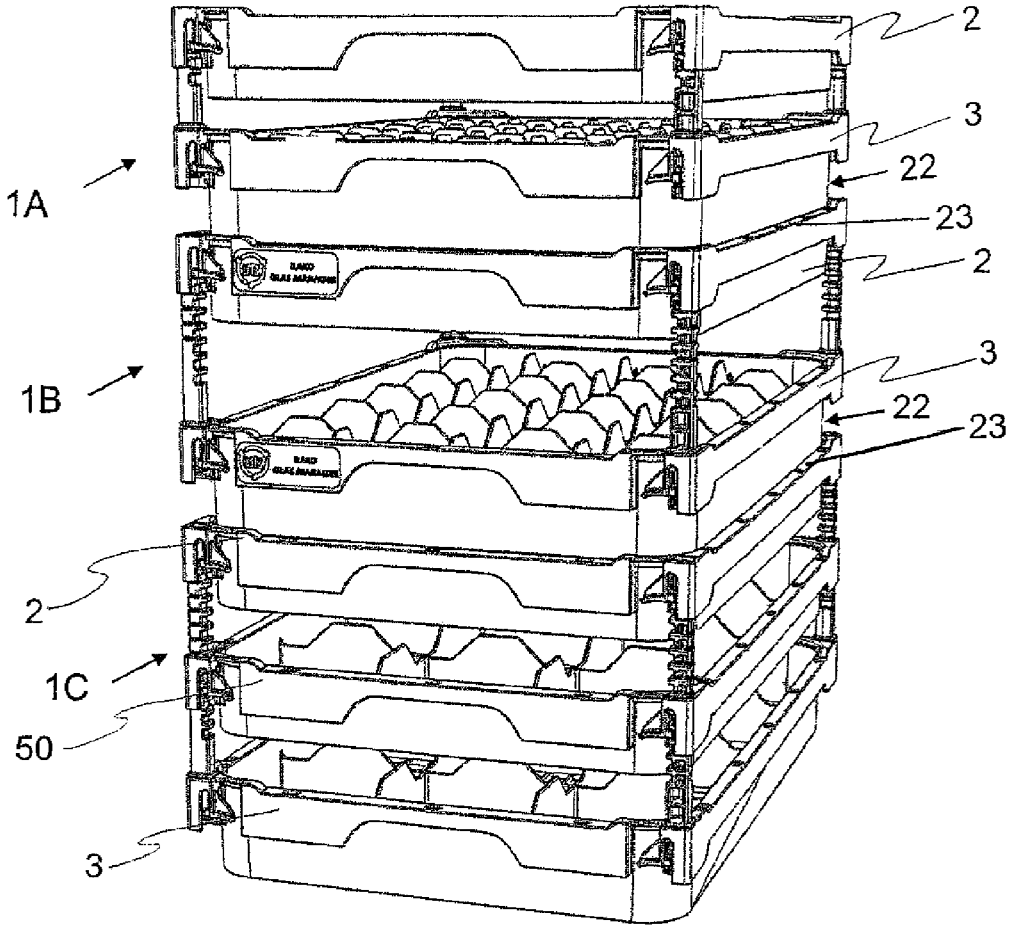
Figure 6:
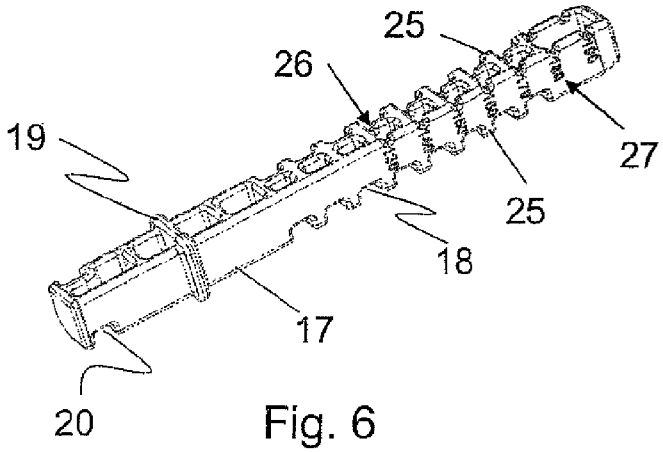
Figure 7:
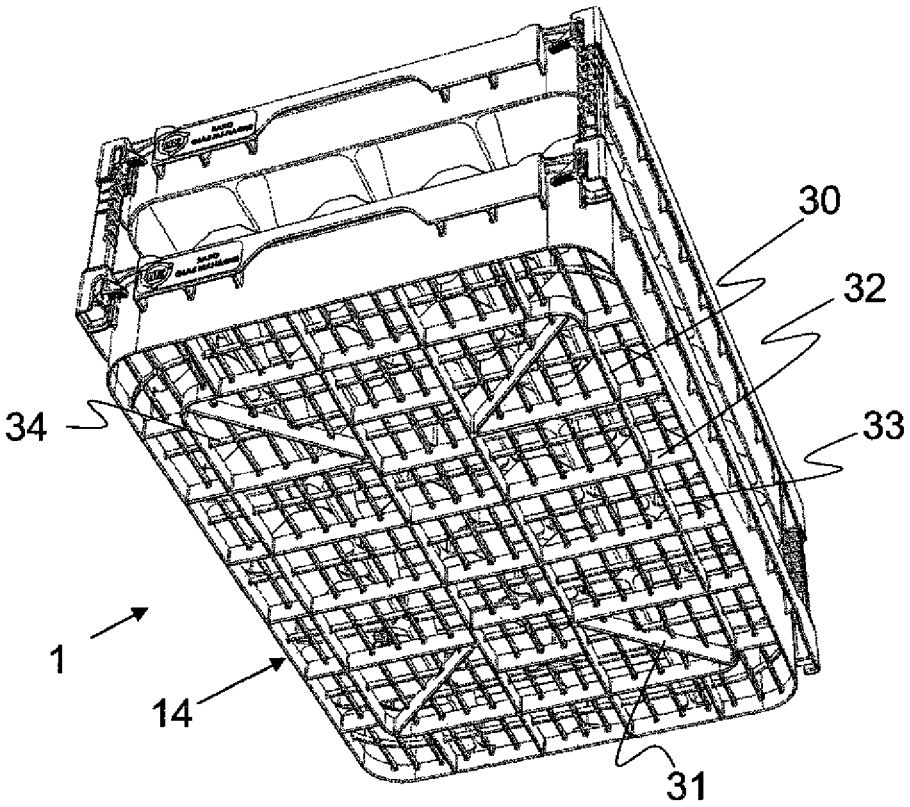
Figure 8:
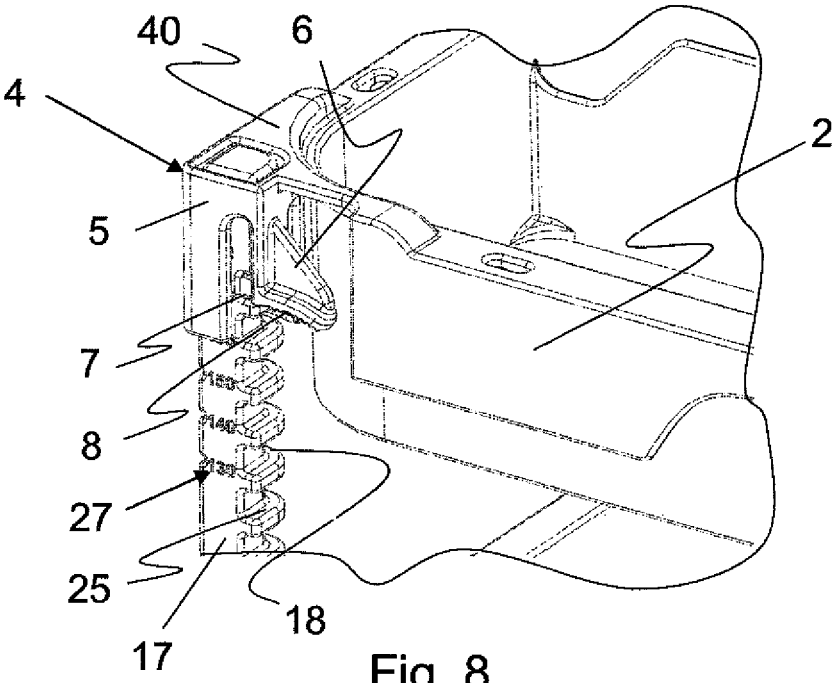

Further advantages of the invention are set forth in the dependent patent claims and in the following description in which an exemplary embodiment of the invention is described in greater detail with reference to the schematic drawings. It is shown in:

FIG. 1 a perspective view of an insert with two insert parts arranged at a first distance, FIG. 2 a perspective view of the same insert with two insert parts arranged at a second distance with the same compartment size, FIG. 3 a perspective view of another insert with different compartment size and two insert parts arranged at the second distance, FIG. 4 a perspective view of an insert with three insert parts, FIG. 5 a perspective view of a stack of three inserts, FIG. 6 a perspective view of a support element for maintaining a distance between the individual parts, FIG. 7 a bottom view of the insert of FIG. 2, and FIG. 8 a cutaway view of the corner region of the insert.

FIG. 1 shows an insert 1 for glassware, here cylindrical water glasses, comprised of an upper insert part 1 and a lower insert part 3 which are of identical configuration. The corner regions 4 of the insert parts 2, 3 are provided with a cylindrical receptacle 5 which is configured in the shape of a square and includes a lateral locking element 6 with a protruding pin 7 and a lever 8. The locking element 6 is resiliently mounted to a bracket 9 which is formed on the receptacle 5. The insert part 2, 3 has a grid-shaped layout 11 comprised of plastic strips 12 which intersect one another (see FIG. 3). The plastic strips 12 have trapezoidal recesses 13 in the area of the intersection points so that glasses 50 placed in the insert 1 can more easily be removed. The leading edge 15, shown in FIG. 1, has a recessed configuration and includes an engagement grip 16. The edge is configured in the same way on the opposite invisible side. The lower insert part 3 is provided with cross ribs 14 on the bottom (see also FIG. 7) for allowing placement of the glasses 50.

The upper insert part 2 is arranged by post-shaped support elements 17 at a distance to the lower insert part 3. For that purpose, the support element 17 is configured as square post with a rectangular serration 18. The pin 7 of the locking element 6 engages the serration 18 so that the two insert parts 2 and 3 are adjustable. The square post of the support element 17 is formed complementary to the square cylinder of the receptacle 5. Furthermore, the support element 17 has in the lower region a circumferential support edge 19 (see also FIG. 6) so that the support element 17 rests upon the upper edge of the receptacle 5 of the lower insert part 3. As shown in FIG. 6, the support element 17 has in the end zone an indentation 20 in which the pin 7 of the locking element 6 engages so that the support element 17 is held at the bottom firmly in the insert part 3.

FIG. 2 shows an insert 1 with support elements 17A which are sized longer than the support elements 17 in FIG. 1. Otherwise, the parts of the insert 1 are configured identically as in FIG. 1. As a result, higher glasses 60, like wine glasses, of same diameter as the water glasses 50 of FIG. 1, can be held in the insert 1 in a stable manner.

FIG. 3 shows an insert 1 of same distance with support elements 17A between the insert parts 2 and 3 as in FIG. 2. However, the compartment size between the plastic strips 12 is greater here so that glasses of greater diameter can be held in this insert 1. FIG. 4 shows an insert 1 with three insert parts 2, 3, and 50, in which the support elements 17B are sized even longer. The middle insert part 50 may hereby be arranged at a same distance to the two upper and lower insert parts 2 and 3. FIG. 5 shows the stack of three inserts 1 of different heights, with the lower edge 22 of the lower insert part 3 being placed upon the upper recessed edge 23 of the upper insert part 2 of a subjacent insert 1.

FIG. 5 shows the stack of the three inserts 1A, 1B and 1C of different heights, as depicted in FIGS. 2, 3, and 4.

As shown in FIG. 6, the post-shaped support element 17 has a rectangular serration 18, with each tooth 25 having a score line 26 to allow the support element 17 to be cut to the correct length. To simplify the respectively adjusted height, the respective locking position 27 is marked on the support element 17 with the numeric indication.

FIG. 7 shows the bottom of the insert 1, with the cross ribs 14 having a rectangular strutting 30 to support large longitudinal and transversal ribs 32 and diagonal ribs 31. Arranged between the large longitudinal and transversal ribs 32 and the diagonal ribs 31 are smaller longitudinal and transversal ribs 33, 34.

FIG. 8 is a detailed view of the corner region 4 of the insert 1, showing more clearly the locking element 6 with the protruding pin 7 and the lever 8. The pin 7 engages in the rectangular serration 18, i.e. is placed upon one tooth 25, so that the upper insert part 2 is locked upon the support element 17. The corner region 4 is provided with a rounded support area 40 which embraces the rounded edge of the lower insert part 2 by precision fit so that the inserts 1 are centered, when stacked.

The invention claimed is:

1. An insert for transport container of plastic for transporting of glass and the like in a shock-resistant manner, said insert comprising a lower insert part and an upper insert part which are substantially of identical configuration and each have a grid-shaped layout of intersecting plastic strips to hold said glasses or the like, and at least two support elements to connect the insert parts at a distance to one another such that the intersecting plastic strips of the lower insert part hold said glasses laterally at their lowermost portion and the intersecting plastic strips of the upper insert part hold said glasses laterally at their uppermost portion, wherein the distance between the insert parts is adjustable to a height of the glasses to be held.

2. The insert of claim 1, wherein each of the insert parts has an edge region formed with open receptacles for passage of the support elements.

3. The insert of claim 2, wherein the receptacles have each a locking element for engagement in a longitudinally oriented serration of the support elements.

4. The insert of claim 3, wherein the support elements have each an end region formed with an indentation for engagement of the locking element of the receptacles of a lower one of the insert parts.

5. The insert of claim 3, wherein the serration has a rectangular configuration and includes teeth, with each of the teeth having a score line to allow to cut the support elements to a desired height.

6. The insert of claim 2, wherein the support elements have each a lower region provided with a circumferential support edge at a distance to an end of the lower region for support on a subjacent one of the receptacles.

7. The insert of claim 2, wherein the insert parts have a rectangular configuration, said receptacles being provided in corner regions of the insert parts.

8. The insert of claim 1, wherein the plastic strips intersect one another at intersection points to thereby establish the grid-shaped layout, said plastic strips having a recess in an area of the intersection points.

9. The insert of claim 1, wherein the insert part has opposite regions, each of the regions being provided with a projecting, recesses edge to form an engagement grip.

* * * * *